US007117899B1

(12) United States Patent
Kim

(10) Patent No.: US 7,117,899 B1
(45) Date of Patent: Oct. 10, 2006

(54) PILE MESH FABRIC

(76) Inventor: Boon Do Kim, 2F, 610-15, Gongneung-1 dong, Nowon-Gu, Seoul (KR)

( * ) Notice: Subject to any disclaimer, the term of this patent is extended or adjusted under 35 U.S.C. 154(b) by 0 days.

(21) Appl. No.: 11/132,011

(22) Filed: May 18, 2005

(51) Int. Cl.
*D02G 3/42* (2006.01)
*D03D 27/00* (2006.01)
*D04B 21/02* (2006.01)

(52) U.S. Cl. ..... 139/395; 139/391; 139/383 R; 139/426 R; 139/416; 66/194

(58) Field of Classification Search ..... 139/383 R, 139/384 R, 391, 392, 393, 395, 416, 419, 139/426 R, 426 TW, DIG. 1; 66/192, 196, 66/194, 193
See application file for complete search history.

(56) References Cited

U.S. PATENT DOCUMENTS 2,774,233 A * 12/1956 Lombardi ..... 66/191
3,071,951 A * 1/1963 Kurz ..... 66/195
3,111,829 A * 11/1963 Artzt ..... 66/194
3,732,708 A * 5/1973 Troy ..... 66/191
4,280,259 A * 7/1981 Bassist ..... 28/160
4,297,858 A * 11/1981 Blasberg et al. ..... 66/194
4,381,805 A * 5/1983 Troy ..... 139/391
4,406,309 A * 9/1983 Czelusniak, Jr. ..... 139/402
4,452,160 A * 6/1984 Tajiri et al. ..... 112/410
4,617,218 A * 10/1986 Cadenhead, Sr. ..... 428/92
4,773,135 A * 9/1988 Sato et al. ..... 28/160
5,010,723 A * 4/1991 Wilen ..... 57/210
5,440,902 A * 8/1995 Wieland et al. ..... 66/194
5,501,891 A * 3/1996 Saika et al. ..... 428/71
5,939,166 A * 8/1999 Cheng et al. ..... 428/92
6,105,400 A * 8/2000 Yoon ..... 66/194
6,105,401 A * 8/2000 Chadeyron et al. ..... 66/195
6,299,959 B1 * 10/2001 Squires et al. ..... 428/87
6,344,254 B1 * 2/2002 Smith et al. ..... 428/95
6,477,865 B1 * 11/2002 Matsumoto ..... 66/195
6,479,125 B1 * 11/2002 Irwin, Sr. ..... 428/95
6,623,830 B1 * 9/2003 Lewis ..... 428/85
6,739,161 B1 * 5/2004 Ohara et al. ..... 66/194
6,740,385 B1 * 5/2004 Gardner et al. ..... 428/85
6,794,009 B1 * 9/2004 Brodeur et al. ..... 428/95
6,815,379 B1 * 11/2004 Nomura ..... 442/123
6,843,077 B1 * 1/2005 Ishihara et al. ..... 66/194
6,926,358 B1 * 8/2005 Fujita et al. ..... 297/216.14

* cited by examiner

*Primary Examiner*—John J. Calvert
*Assistant Examiner*—Robert H Muromoto
(74) *Attorney, Agent, or Firm*—Park Law Firm; John K. Park

(57) ABSTRACT

A pile mesh fabric includes a ground thread woven on a first surface and a pile thread woven into the ground thread. The ground includes a plurality of closely-spaced holes into forming a mesh. The pile thread of a predetermined length extends perpendicularly to the surface of the mesh and the pile thread is inserted and bound to the ground thread. The mesh includes a pattern of hexagon, rectangle, rhomboid, or octagon. The hexagon has a side of length of about one to ten millimeters. The ground thread includes synthetic fibers or natural fibers. The synthetic fiber includes a yarn of nylon, polyester, or rayon. The natural fiber includes a cotton yarn. The pile thread includes a yarn of cotton, nylon, polyester, or rayon. The predetermined length of the pile thread is from about three to twenty millimeters. The pile thread includes a single or a plurality of filaments.

14 Claims, 4 Drawing Sheets

10

PILE MESH FABRIC

BACKGROUND OF THE INVENTION

The present invention relates to a pile mesh fabric. More particularly, this invention relates to a pile mesh fabric with mesh network of thread and pile from the network of thread.

Sports mesh is a well-known material for many applications. Contrary to the regular fabric, the sports mesh has relatively large holes across its surface, which is suitable for ventilation and partial look-through. Since it is not woven closely, the sports mesh is also light in weight. With a proper choice of thread for the mesh, the sports mesh is strong and light enough to be used in a lot of applications including sports equipment.

On the other hand, the pile on the surface of carpets has a long history since sometime between the 4th and 2nd millennium BC. The pile rises from the surface of the weave at a perpendicular angle, and gives a three-dimensional structure and smooth touching to the base weave.

Usually, the fabric with piles was used for the clothes of the fall and the winter since it provides some extra warmth to the cloth.

The application of pile to a sports mesh is desirable in some applications. The outlook or utility of the sports mesh can be facilitated by adding the piles. The fabric would be able to make to be even more fashionable with piles.

Accordingly, a need for a pile mesh fabric has been present for a long time. The invention is directed to solve these optimization problems to combine the two features and satisfy the long-felt need.

SUMMARY OF THE INVENTION

The present invention contrives to solve the disadvantages of the prior art.

An objective of the invention is to provide a pile mesh fabric with a three-dimensional surface structure.

Another objective of the invention is to provide a pile mesh fabric which has enhanced touch by piles.

Still another objective of the invention is to provide a method for manufacturing the pile mesh fabric.

A pile mesh fabric includes a ground thread and a pile thread, and the pile thread is inserted and bound to the ground thread and includes a cut end.

The ground thread is woven on a first surface and forms a plurality of closely-spaced holes. The pile thread of a predetermined length extends perpendicularly to the surface of the mesh.

The ground thread forms a mesh. And, the mesh includes a pattern of hexagonal lattice. The hexagon has a side of length of about one (1) to about ten (10) millimeters. The mesh includes a pattern of rectangle, rhomboid, or octagon.

The ground thread includes a synthetic fibers including a yarn of nylon, polyester, or rayon. Also, the ground thread includes a natural fibers including a cotton yarn.

The pile thread includes a yarn of cotton, nylon, polyester, or rayon. The predetermined length of the pile thread is from about three (3) to about twenty (20) millimeters.

The pile thread includes a single filament or a plurality of filaments. For a plurality of filaments, the pile thread is braided and the length of the pile thread is larger than a predetermined value, about five (5) millimeters.

The pile thread has a predetermined length above the surface defined by the ground thread. The predetermined length of the pile thread is from about three (3) to about twenty (20) millimeters.

A method for manufacturing of a pile mesh fabric includes steps of weaving a ground thread to form a mesh in a predetermined pattern, inserting a loop along the ground thread on a surface of the mesh, and cutting the top of the loop. The step of inserting the loop is done while the mesh is woven.

The advantages of the present invention are: (1) the pile mesh fabric has a better touch due to the three-dimensional surface structure; and (2) the pile mesh fabric has both merits of a sports mesh and a pile such as lightness and strength.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
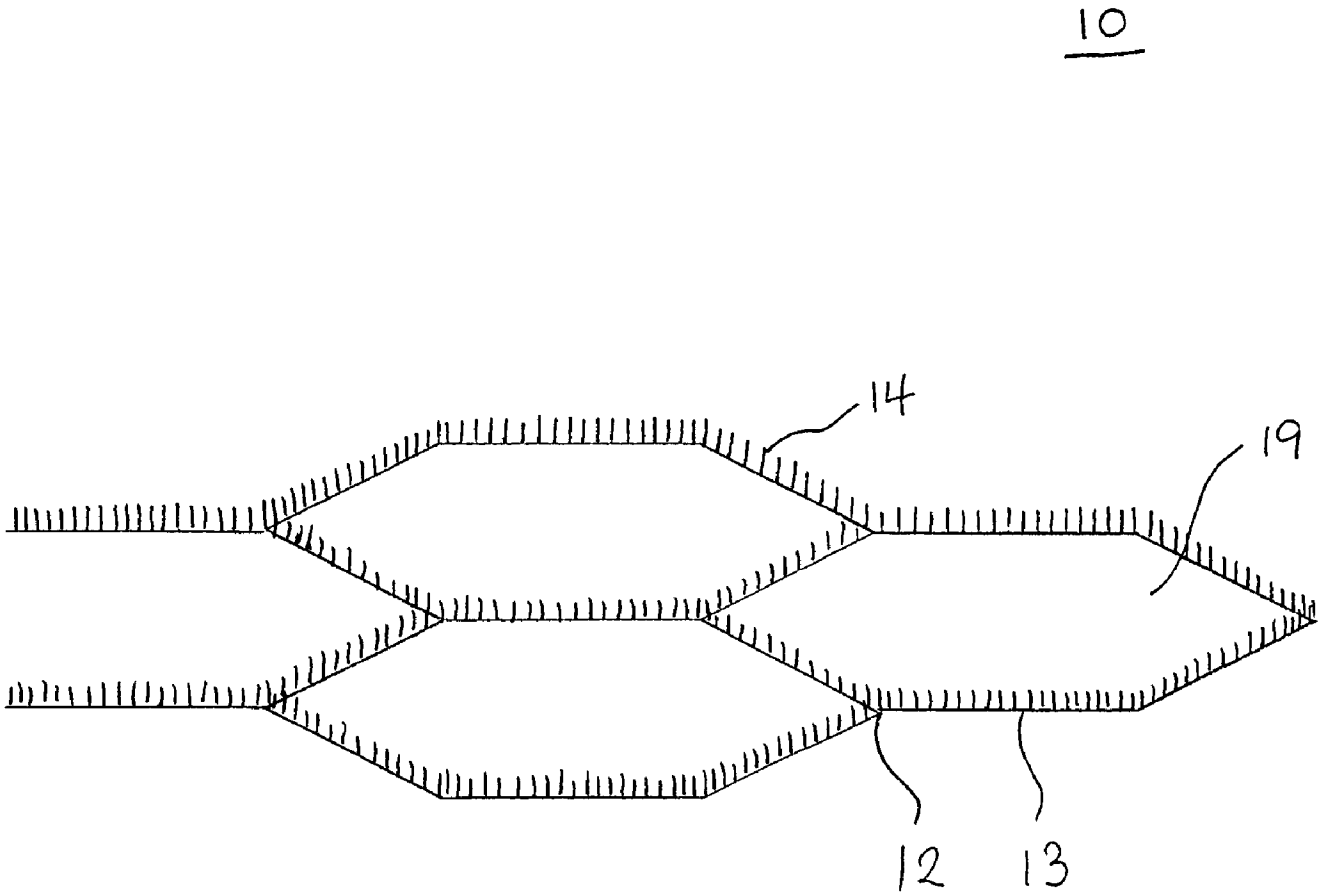
FIG. 1 is a perspective view showing a patch of mesh with piles.
Figure 2:
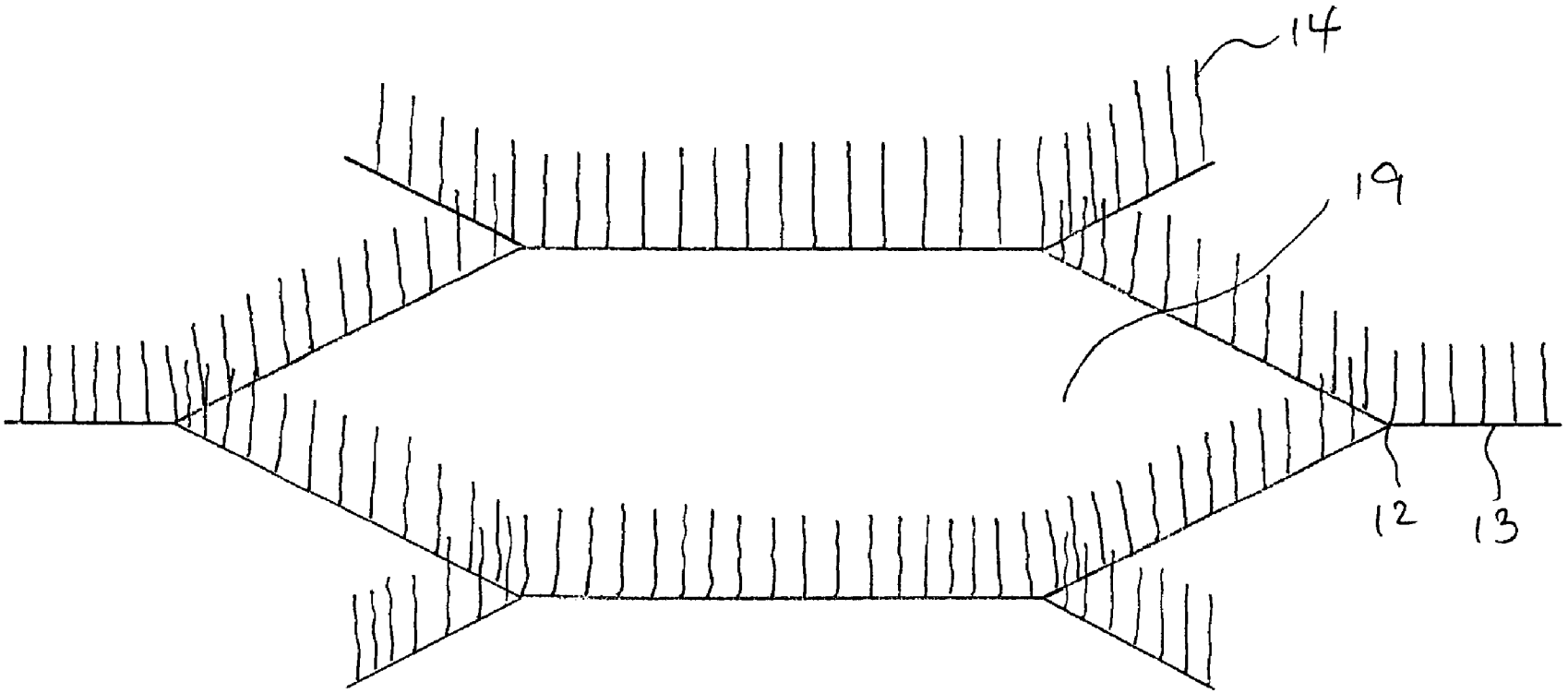
FIG. 2 is an enlarged perspective view showing a hole of mesh with piles.

FIG. 1 and FIG. 2 show a patch of mesh with piles according to the present invention.

The pile mesh fabric 10 includes a ground thread 13 and a pile thread 14, and the pile thread 14 is inserted and bound to the ground thread 13 and includes a cut end.

The ground thread 13 is woven on a first surface and forms a plurality of closely-spaced holes 19. The pile thread 14 of a predetermined length extends perpendicularly to the surface of the mesh 12.

The ground thread 13 forms the mesh 12. And, the mesh 12 includes a pattern of hexagonal lattice. The hexagon has a side of length of about one (1) to about ten (10) millimeters. The mesh 12 includes a pattern of rectangle, rhomboid, or octagon.

The ground thread 13 includes a synthetic fibers including a yarn of nylon, polyester, or rayon. Also, the ground thread 13 includes a natural fibers including a cotton yarn.

The pile thread 14 includes a yarn of cotton, nylon, polyester, or rayon. The predetermined length of the pile thread 14 is from about three (3) to about twenty (20) millimeters.

The pile thread 14 includes a single filament or a plurality of filaments. For a plurality of filaments, the pile thread 14 is braided and the length of the pile thread 14 is larger than a predetermined value, about five (5) millimeters.

The pile thread 14 has a predetermined length above the surface defined by the ground thread 13. The predetermined length of the pile thread 14 is from about three (3) to about twenty (20) millimeters.

Figure 3:
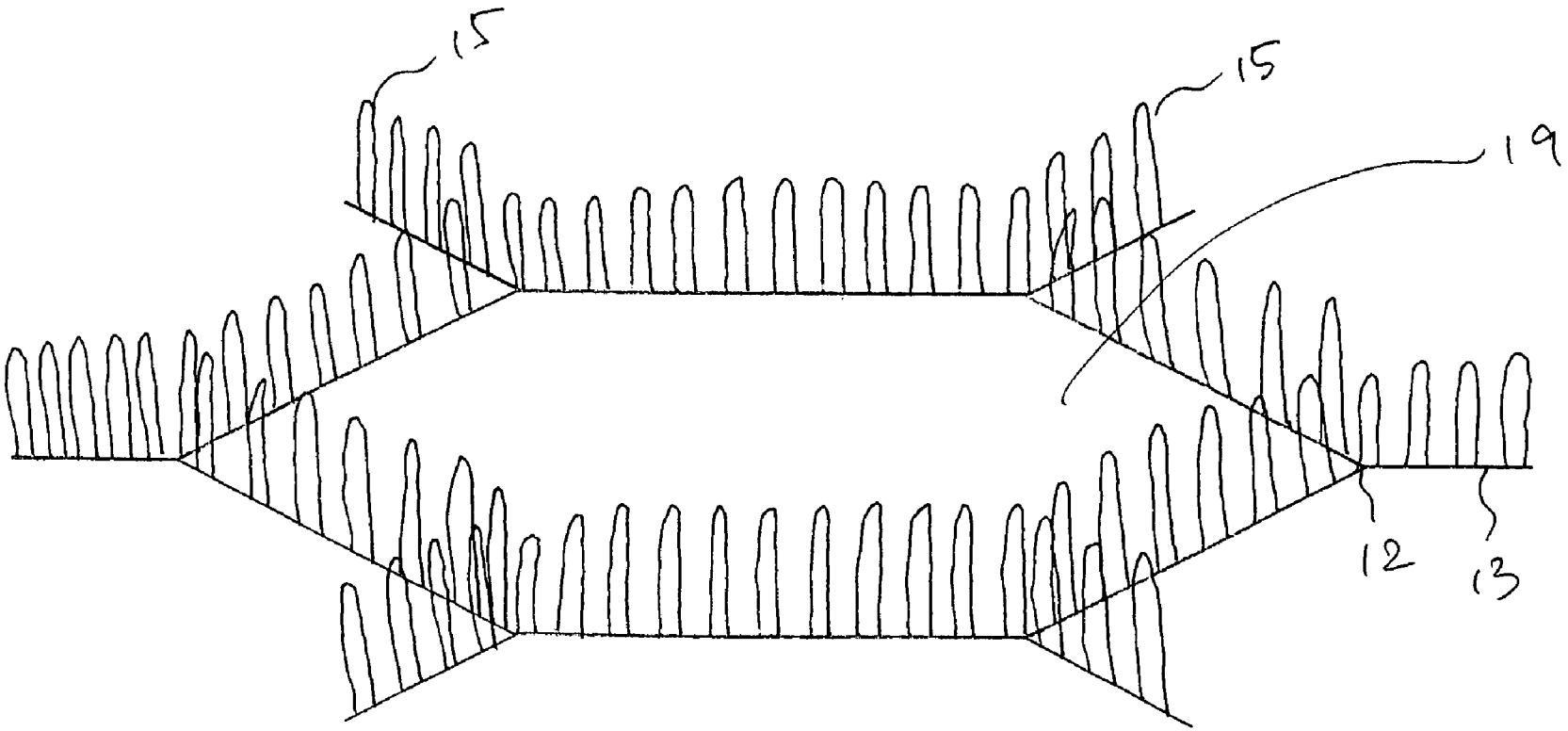
FIG. 3 is a perspective view showing a patch of mesh woven with loops.
Figure 4:
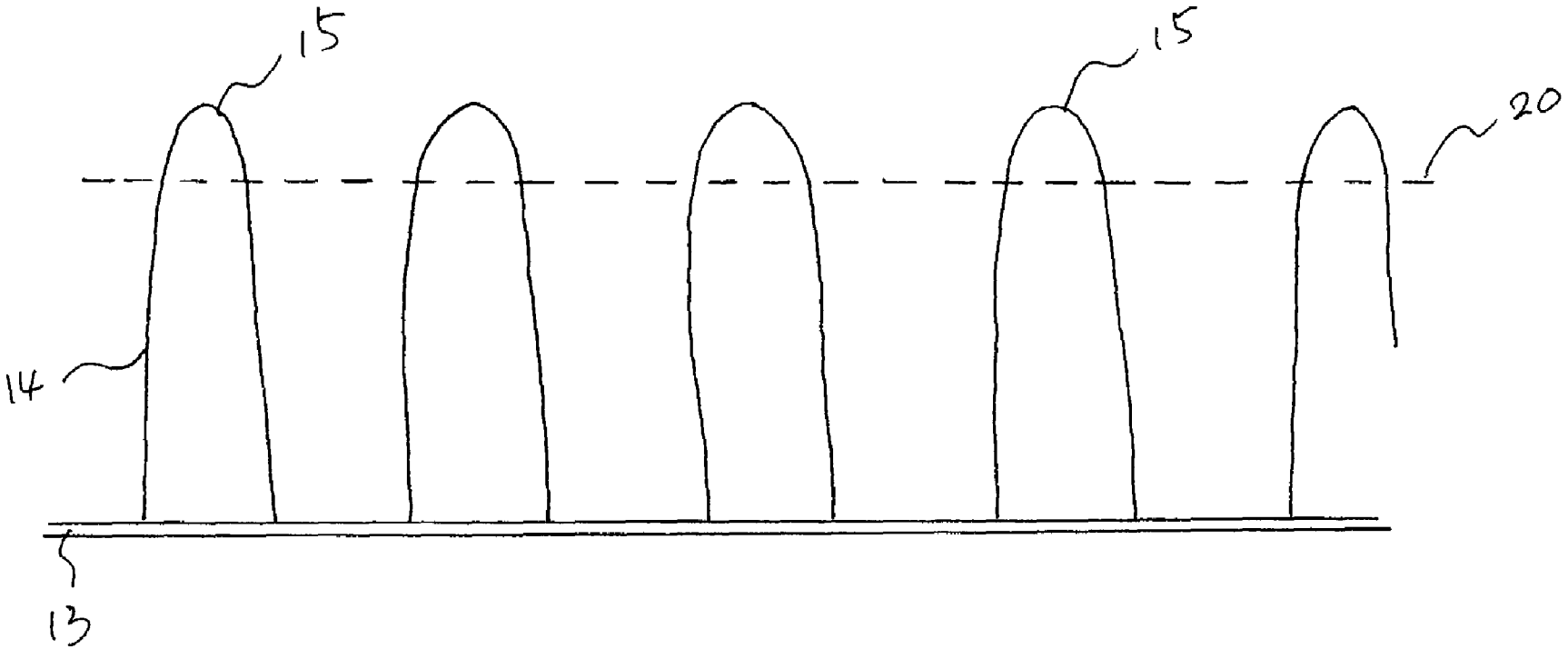
FIG. 4 is an enlarged side view showing loops on a ground thread.

A method for manufacturing of a pile mesh fabric 10 includes steps of weaving a ground thread 13 to form a mesh 12 in a predetermined pattern, inserting a loop 15 (refer to FIG. 3 and FIG. 4) along the ground thread 13 on a surface of the mesh 12, and cutting the top of the loop 15 along the cut line 20 as shown in FIG. 4. The step of inserting the loop 15 is done while the mesh 12 is woven.

The mesh 12 may be woven with the ground threads 13 with a plurality of filaments, too.

The pile mesh fabric 10 can be manufactured with commercially available well-known machines such as Double Fringe machine, Double Lossel machine, or Warp Knitting machine.

The choice for the ground thread 13 and the pile thread 14 is wide from natural yarns to synthetic yarns, enabling a wide range of fashion concerns.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A pile mesh fabric comprising:

a) a ground threads woven on a first surface, wherein the ground threads forming a mesh, said mesh comprising a hexagonal lattice pattern, b) a pile thread of a predetermined length extending perpendicularly to the surface of the mesh, wherein the pile thread is inserted and bound to the ground thread and comprises a cut end.

2. The pile mesh fabric of claim 1, wherein the hexagon has a side of length of about one (1) to about ten (10) millimeters.

3. The pile mesh fabric of claim 1, wherein the ground thread comprises a synthetic fibers.

4. The pile mesh fabric of claim 3, wherein the synthetic fiber comprises a yarn of nylon, polyester, or rayon.

5. The pile mesh fabric of claim 1, wherein the ground thread comprises a natural fibers.

6. The pile mesh fabric of claim 5, wherein the natural fiber comprises a cotton yarn.

7. The pile mesh fabric of claim 1, wherein the pile thread comprises a yarn of cotton, nylon, polyester, or rayon.

8. The pile mesh fabric of claim 7, wherein the predetermined length of the pile thread is from about three (3) to about twenty (20) millimeters.

9. The pile mesh fabric of claim 1, wherein the pile thread comprises a single filament.

10. The pile mesh fabric of claim 1, wherein the pile thread comprises a plurality of filaments.

11. The pile mesh fabric of claim 10, wherein the pile thread is braided, wherein the length of the pile thread is larger than about 5 mm.

12. The pile mesh fabric of claim 1, wherein the pile thread has a predetermined length above the surface defined by the ground thread.

13. The pile mesh fabric of claim 12, wherein the predetermined length of the pile thread is from about three (3) to about twenty (20) millimeters.

14. A method for manufacturing of a pile mesh fabric comprising steps of:

a) weaving a ground thread to form a mesh in a hexagonal lattice pattern;

b) inserting a loop along the ground thread on a surface of the mesh; and c) cutting the top of the loop, wherein the step of inserting the loop is done while the mesh is woven.

* * * * *